US007213780B2

(12) United States Patent
Chen

(10) Patent No.: US 7,213,780 B2
(45) Date of Patent: May 8, 2007

(54) MULTIFUNCTIONAL PAPER SHREDDER

(75) Inventor: Pai-Hsien Chen, Taipei (TW)

(73) Assignee: Aurora Global Investment Ltd., Shanghai (CN)

( * ) Notice: Subject to any disclaimer, the term of this patent is extended or adjusted under 35 U.S.C. 154(b) by 147 days.

(21) Appl. No.: 11/054,180

(22) Filed: Feb. 9, 2005

(65) Prior Publication Data

US 2006/0175444 A1 Aug. 10, 2006

(51) Int. Cl.
*B02C 18/22* (2006.01)

(52) U.S. Cl. ..... 241/100; 241/236; 241/285.2

(58) Field of Classification Search ..... 241/100, 241/236, 285.2

See application file for complete search history.

(56) References Cited

U.S. PATENT DOCUMENTS 3,682,402 A * 8/1972 Goldhammer ..... 241/100
6,550,701 B1 * 4/2003 Chang ..... 241/36
6,595,444 B2 * 7/2003 Schwelling ..... 241/37.5

FOREIGN PATENT DOCUMENTS

GB 2169524 * 7/1986 ..... 241/236
TW 551221 4/2002

* cited by examiner

*Primary Examiner*—Mark Rosenbaum
(74) *Attorney, Agent, or Firm*—Bucknam and Archer

(57) ABSTRACT

Disclosed is a sliding panel structure of a multifunctional paper shredder, the paper shredder includes a housing having an interior space, an installing section at the top, an accommodating space at the bottom, and a feeding slot under the installing section. A pair of rolling blade wheels are disposed under the feeding slot which has a pressing wall surface extended vertically downward and aligned with the middle of the rolling blade wheels. An accommodating section is defined at the top of the housing, and a positioning section having at least one sliding groove is disposed at an inner side of the accommodating section. A sliding panel, having a plurality of slots is slidably installed in the accommodating section, having a positioning pin disposed in the positioning section correspondingly, and at least one slide pin embedded into the sliding groove for guiding the movement of the sliding panel.

13 Claims, 7 Drawing Sheets

MULTIFUNCTIONAL PAPER SHREDDER

BACKGROUND OF THE INVENTION

1. Field of the Invention

The present invention relates to a sliding panel structure of a multifunctional paper shredder, and more particularly to a sliding panel design having a plurality of slots for receiving and scrapping paper of different materials, credit cards, and compact discs by selectively putting the paper, credit cards and compact discs into the specially designed slots.

2. Description of the Related Art

A paper shredder may be used to shred abandoned documents and papers to prevent disclosing confidential information or trade secrets, and the paper shredder is used extensively in industry and commerce. A conventional paper shredder as shown in FIGS. 1*a* and 1*b* and disclosed in the R.O.C. Utility Model Publication 551221 entitled "Two-way paper shredder" comprises: a housing 10 having a first and a second paper inlets 11, 13 at the top and the lateral side of the housing 10 respectively, a first and a second passages 12, 14 disposed inside the first and second paper inlets 11, 13 respectively, and the bottoms of the first and second passages 12, 14 are interconnected to define a paper guide passage 15; a cutting knife 20 installed in the housing 10 with a predetermined inclined angle, and the cutting knife 20 has a paper shredding inlet 26, and the paper shredding inlet 26 is aligned and connected to the foregoing paper guide passage 15; a dynamic power mechanism 30 disposed in the housing 10 for driving the cutting knife 20; therefore, the thickness of the paper shredder can be reduced by the inclined angle of the cutting knife 20, while the first paper inlet 11 or the second paper inlet 13 can feed a piece of paper, and the paper passes through the first passage 12 and the correspondent second passage 14 to the paper guide passage 15 connected to the paper shredding inlet 26 and the paper is cut into stripes by the cutting knife 20.

Although the aforementioned prior art has a two-way inlet separately disposed on the top and lateral side of the housing which is quite convenient for users in certain ideal situations, the media for containing confidential materials in the current industry and commerce and the society with diversified information activities nowadays are no longer limited to paper, but including lots of plastic materials such as credit cards, compact disks, and the like. The persons skilled in the art can understand that the plastic material has very different thickness, hardness, tenacity and flexibility from those of paper. As to the disclosed prior art or the present paper shredders, no special design is provided for destroying abandoned data stored in different media, and the conventional paper shredders are designed for shredding paper only. Since paper is thin and very flexible, therefore the paper feeding inlet is generally designed relatively wide and large. If an abandoned credit card or compact disc is put directly into the general paper feeding inlet, the credit card or compact disc will be fed with a deviated angle and cannot be aligned with the middle of the two roller blades, and thus causing the roller blades to pulsate severely or even jamming the roller blades, so that they cannot be shredded or scraped successfully.

SUMMARY OF THE INVENTION

In view of the shortcomings of the use of a conventional paper shredder, it is a primary objective of the present invention to provide a sliding panel of a multifunctional paper shredder to improve the technical problems of the prior arts.

To achieve the foregoing objective and other objectives, the present invention comprises:

a housing, having a top panel at its top, enclosing an interior space, and having an installing section disposed at an upper section of the interior space and an accommodating space disposed at a lower section of the interior space, and a feeding slot being defined on the top panel;

a pair of rolling blade wheels, driven by a dynamic force and installed at the installing section under the feeding slot; wherein the feeding slot has a wall surface extended perpendicularly and aligned at the middle of the rolling blade wheels; an accommodating section is formed at the top panel, and a positioning section perpendicular to the feeding slot is disposed on an inner side of the accommodating section, and the positioning section has a plurality of aligners disposed thereon, and a sliding groove parallel to the positioning section is disposed on both sides; a sliding panel comprises a plurality of inlets being slidably installed and sliding in the accommodating section, and the sliding panel has a positioning pin passing through the positioning section correspondingly, and a pair of sliding pins is embedded into the sliding groove for guiding the. movement of the sliding panel.

In the present invention, the first inlet of the sliding panel includes a guide section having a length suitable for feeding a piece of paper and a larger width, a smaller height and a smoother angle, such that when the positioning pin is situated at the first aligner, the first inlet is aligned with the feeding slot. The second inlet of the sliding panel includes a guide section having a length suitable for feeding credit cards and a smaller width, a larger height and a smaller angle, such that when the positioning pin is situated at the second aligner, the second inlet is aligned with a wall surface perpendicular to the feeding slot. The third inlet of the sliding panel includes a guide section having a length suitable for feeding compact discs and a smaller width, a larger height and a smaller angle, such that when the positioning pin is situated at the third aligner, the third inlet is aligned with a wall surface perpendicular to the feeding slot. Therefore, the paper with different materials, the credit cards and the compact discs can be selectively placed into the specially designed inlets and shredded successfully.

BRIEF DESCRIPTION OF THE DRAWINGS

To make it easier for our examiner to understand the objective of the invention, its structure, innovative features, and performance, we use a preferred embodiment together with the attached drawings for the detailed description of the invention.

DETAILED DESCRIPTION OF THE PREFERRED EMBODIMENTS

The technical characteristics of the present invention will be further described by way of example and in terms of a preferred embodiment, and it is to be understood that the invention is not limited to the disclosed embodiment. A better understanding of the invention will be achieved by the following detailed description taken with the accompanying drawing.

Figure 1B:
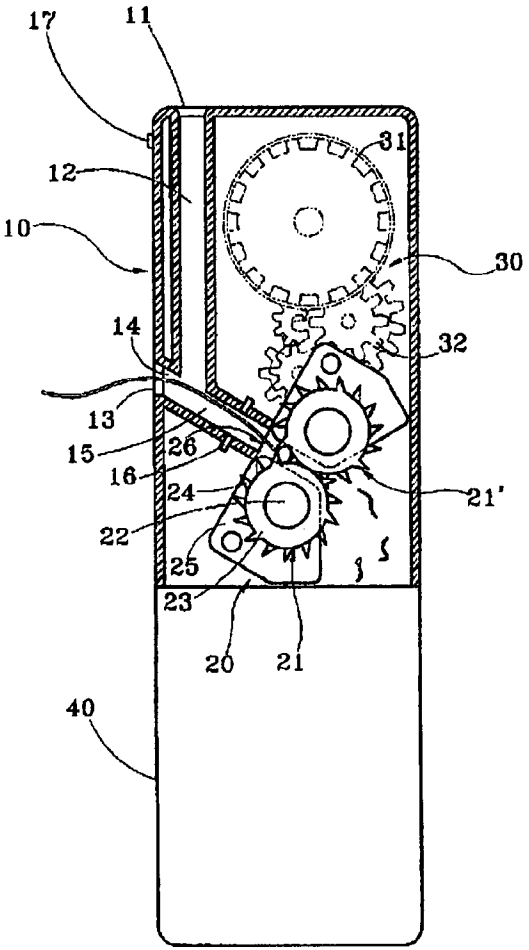
( PRIOR ART ) FIG. 1b
FIG. 1*b* is a schematic view of another way of using the two-way paper shredder as depicted in FIG. 1*a;*
Figure 1A:
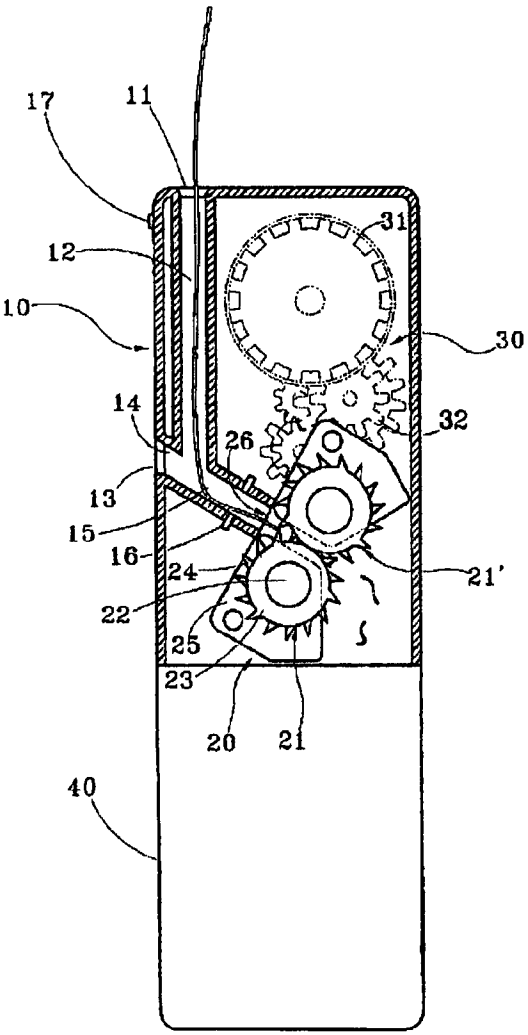
( PRIOR ART ) FIG. 1a
FIG. 1*a* is a schematic view of a two-way paper shredder adopted from the drawing as disclosed in the R.O.C. Utility Model Publication No. 551221.
Figure 2:
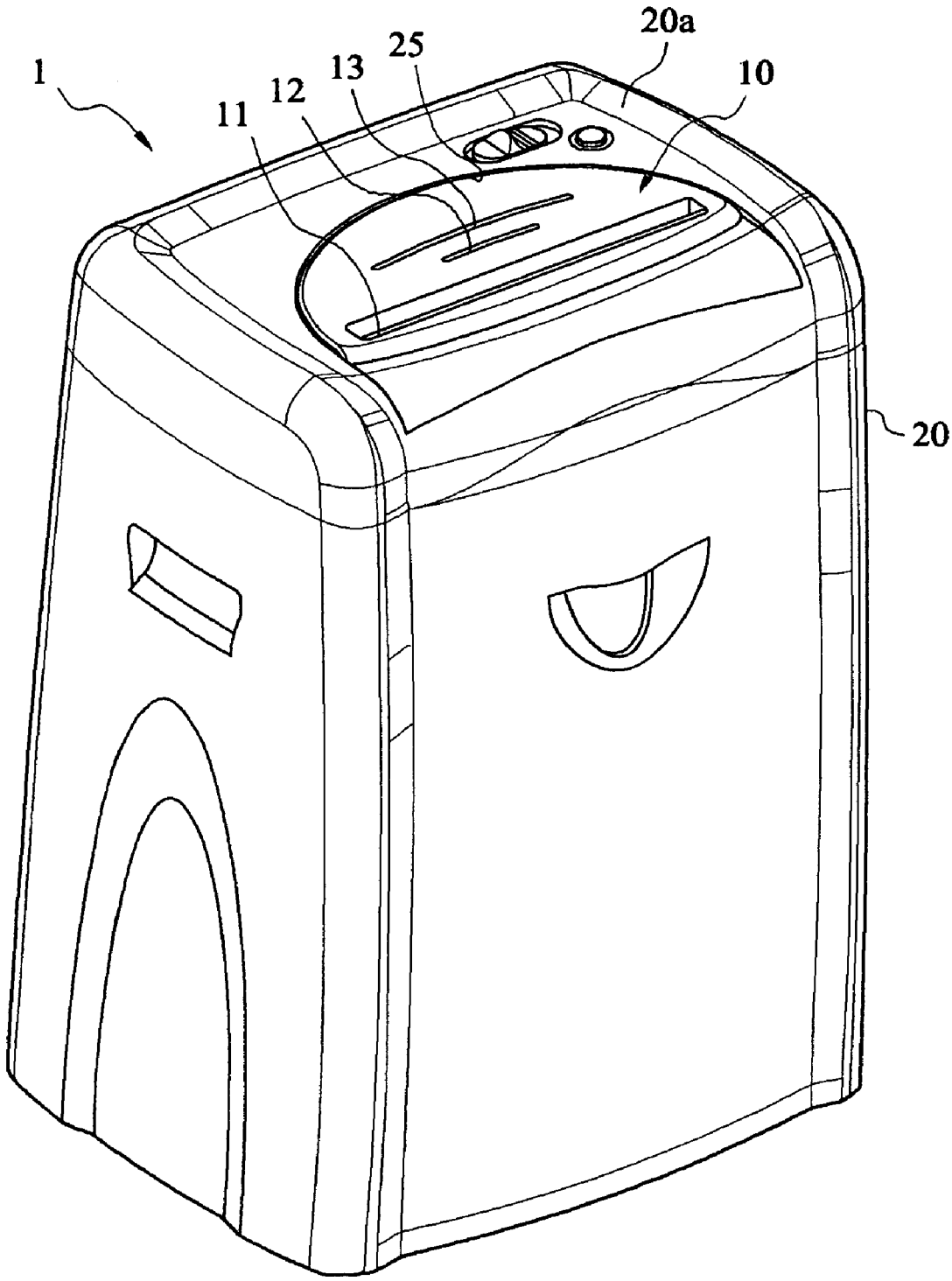
FIG. 2 is a perspective view of a sliding panel structure installed onto a paper shredder according to the present invention.
Figure 3:
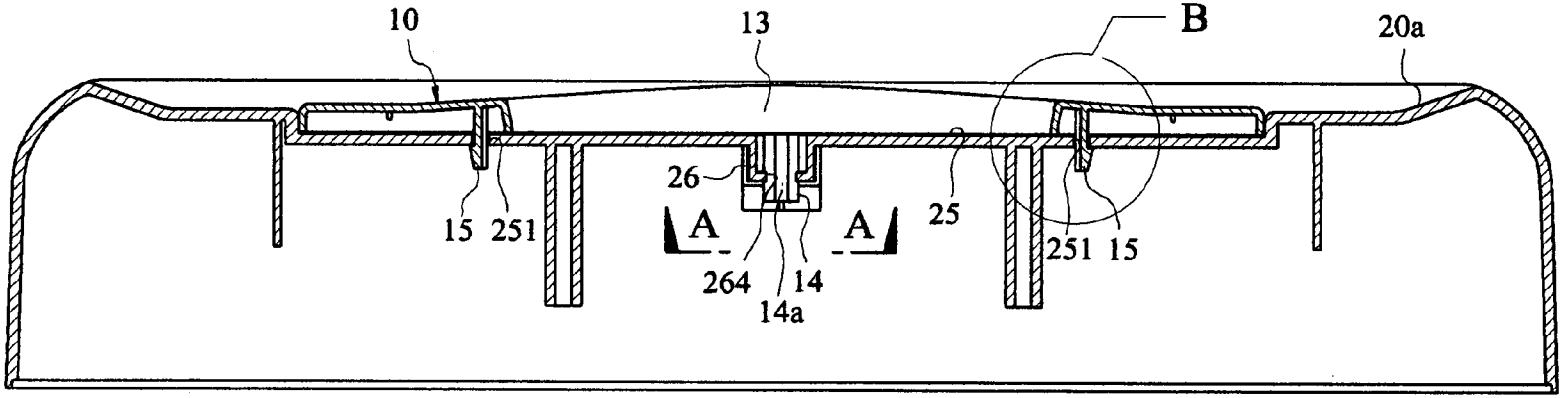
FIG. 3 is a schematic cross-sectional view of the front part of a sliding panel structure according to the present invention.
Figure 4:
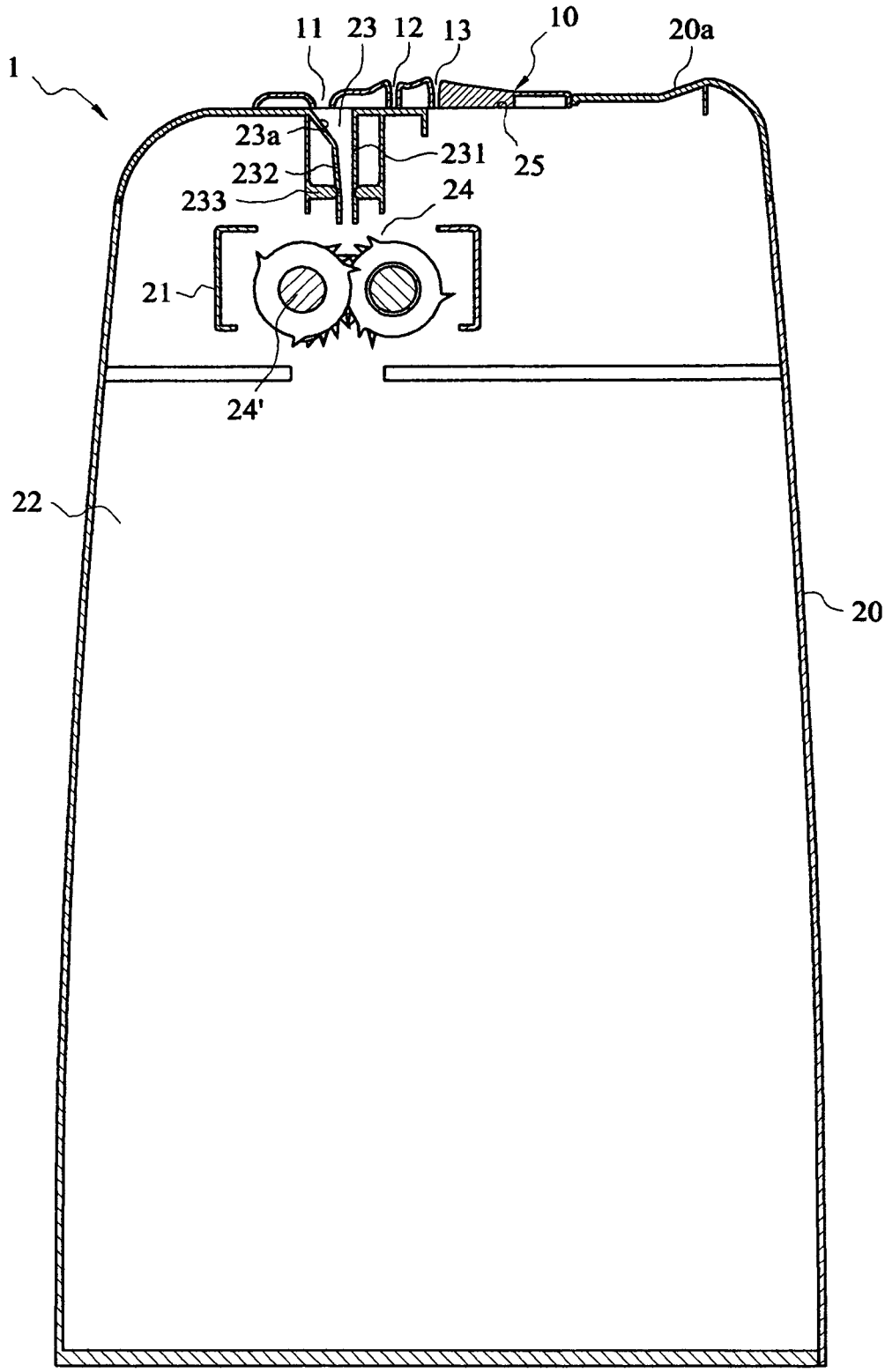
FIG. 4 is a schematic cross-sectional view of a lateral side of the structure as shown in FIG. 2.

Referring to FIGS. 2, 3 and 4, a sliding panel structure 10 of a multifunctional paper shredder in accordance with the present invention relates to a paper shredder 1, comprising: a housing 20, having a top panel 20*a* to define an interior space, an installing section 21 at the top section of the interior space, and an accommodating space 22 at the bottom section. The top panel 20*a* of the housing 20 forms a semicircular accommodating space 25, and a feeding slot 23 is disposed on the accommodating section 25. A pair of actuating elements 24 respectively installs a knife and is fixed on the installing section 21 constituting a pair of rolling blade wheels 24 driven by a dynamic force, and the middle of the rolling blade wheels 24 is connected under the feeding slot 23. At an inner side parallel to the foregoing feeding slot 23, a perpendicular pressing wall surface 231 and a guide wall 232 are provided to define an inwardly tapered guide section 23*a*, and the bottom of the guide section 23*a* is aligned with the middle of the rolling blade wheels 24. A sliding panel 10 forms a semicircular shape with respect to the accommodating section 25 of the top panel 20*a*, and is accommodated and capable of sliding in the accommodating space 25. The sliding panel 10 comprises a first inlet 11, a second inlet 12 and a third inlet 13, and these inlets are of unequal lengths. Further, a pair of infrared sensors 233 are disposed on the external sides on both sidewalls 231, 232 of the feeding slot 23, and a circuit controls a power unit to rotate or stop the rolling blade wheels 24.

Figure 3B:
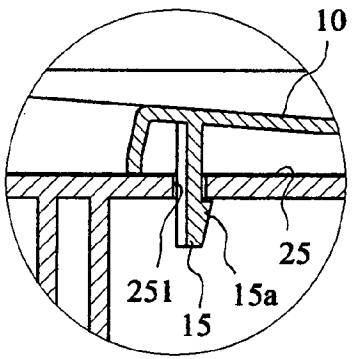
FIG. 3*b* is an enlarged view of the part labeled by Circle B as shown in FIG. 3.
Figure 3A:
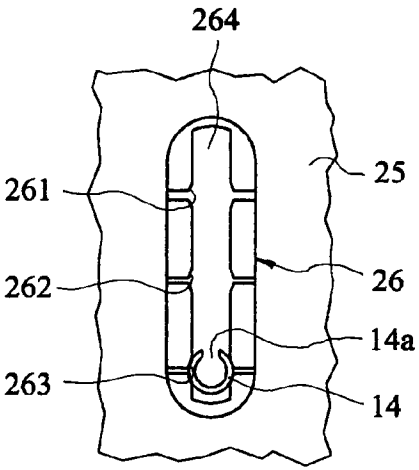
FIG. 3*a* is a schematic bottom view of a part of the structure along Section A—A as shown in FIG. 3.

In the present invention, a positioning section 26 perpendicular to the feeding slot 23 is disposed at the center of an inner side of the accommodating section 25 of the top panel 20*a*, and the positioning section 26 has a first aligner 261, a second aligner 262, and a third aligner 263, and a sliding groove 264 interconnects these three aligners. A pair of sliding grooves 251 parallel to the positioning section 26 is installed on the accommodating section 25 on both sides of the positioning section 26. The sliding panel 10 has a positioning pin 14 at its bottom passing through the positioning section 26 and can slide along the sliding groove 264, and the positioning pin 14 has a sliding pin 15 separately disposed on the left and right sides of the positioning pin 14 and is embedded correspondingly and capable of sliding in the sliding groove 251. The sliding pin 15 forms a hook section 15*a* at an external side of its end, such that the sliding panel 10 will not be separated easily during its sliding (as shown in FIG. 3*b*). In the present invention, the width of the sliding groove 264 is slightly smaller than the first aligner 261, the second aligner 262 and the third aligner 263, and also is slightly smaller than the external diameter of the positioning pin 14. The transversal cross section of the positioning pin 14 is C-shaped and has a deflected opening 14*a*, and thus providing several sections when the positioning pin 14 slides back and forth into the aligners (as shown in FIG. 3*a*).

Figure 5:
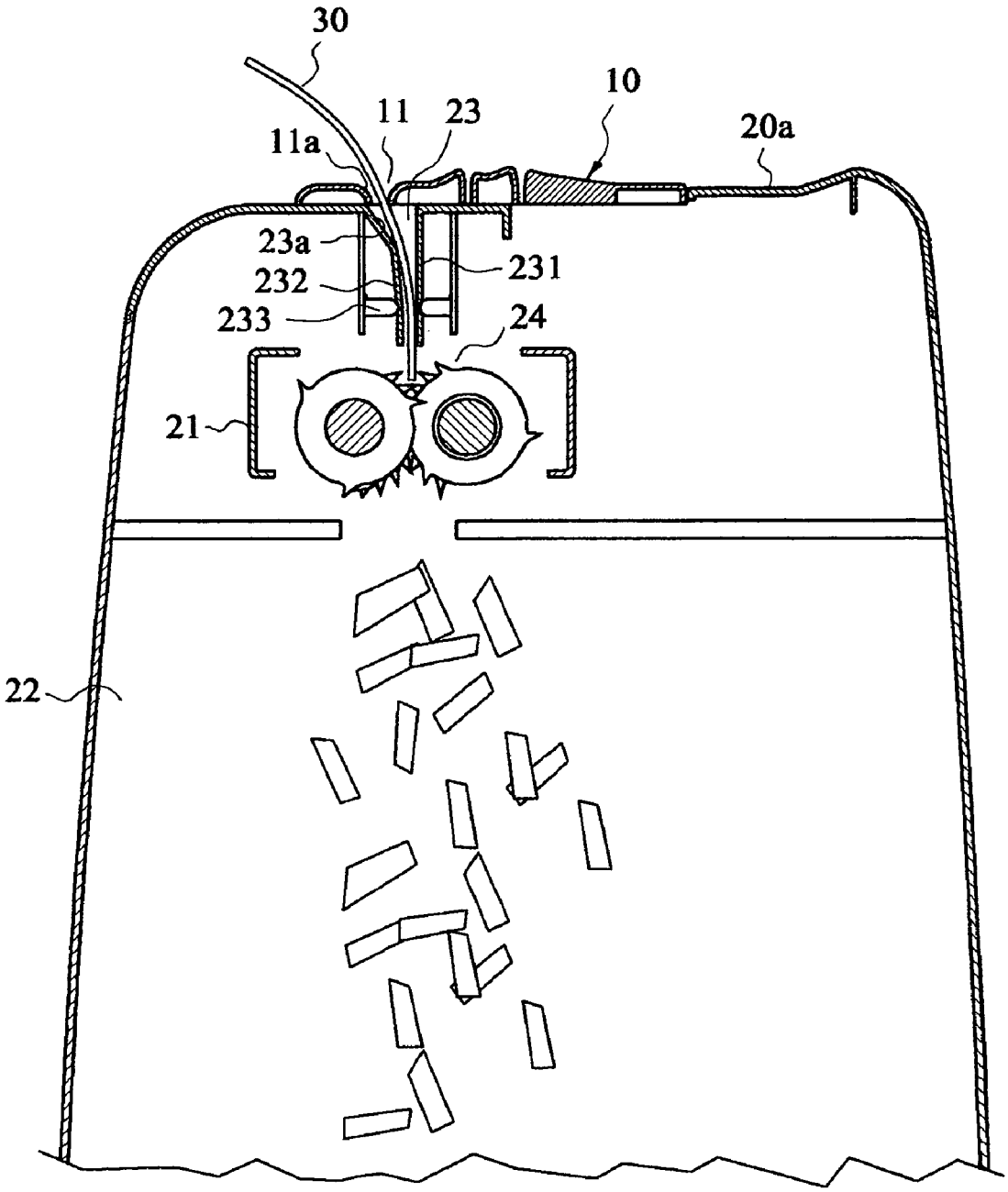
FIG. 5 is a schematic view of a first use of the sliding panel structure according to the present invention.

Referring to FIG. 5, the first inlet 11 of the sliding panel 10 in accordance with the present invention has a length suitable for feeding a piece of paper 30 and the first inlet 11 forms a guide section 11*a* having a larger width, a smaller height, and a smoother angle, such that when the positioning pin 14 falls into the first aligner 261, the first inlet 11 is aligned with the top of the guide section 23*a* of the feeding slot 23. If a piece of paper 30 is placed into the first inlet 11, the paper 30 will be guided into the rolling blade wheels 24 through both sidewalls 231, 232 of the feeding slot 23 for the shredding due to the thinness and good flexibility of the paper 30.

Figure 6:
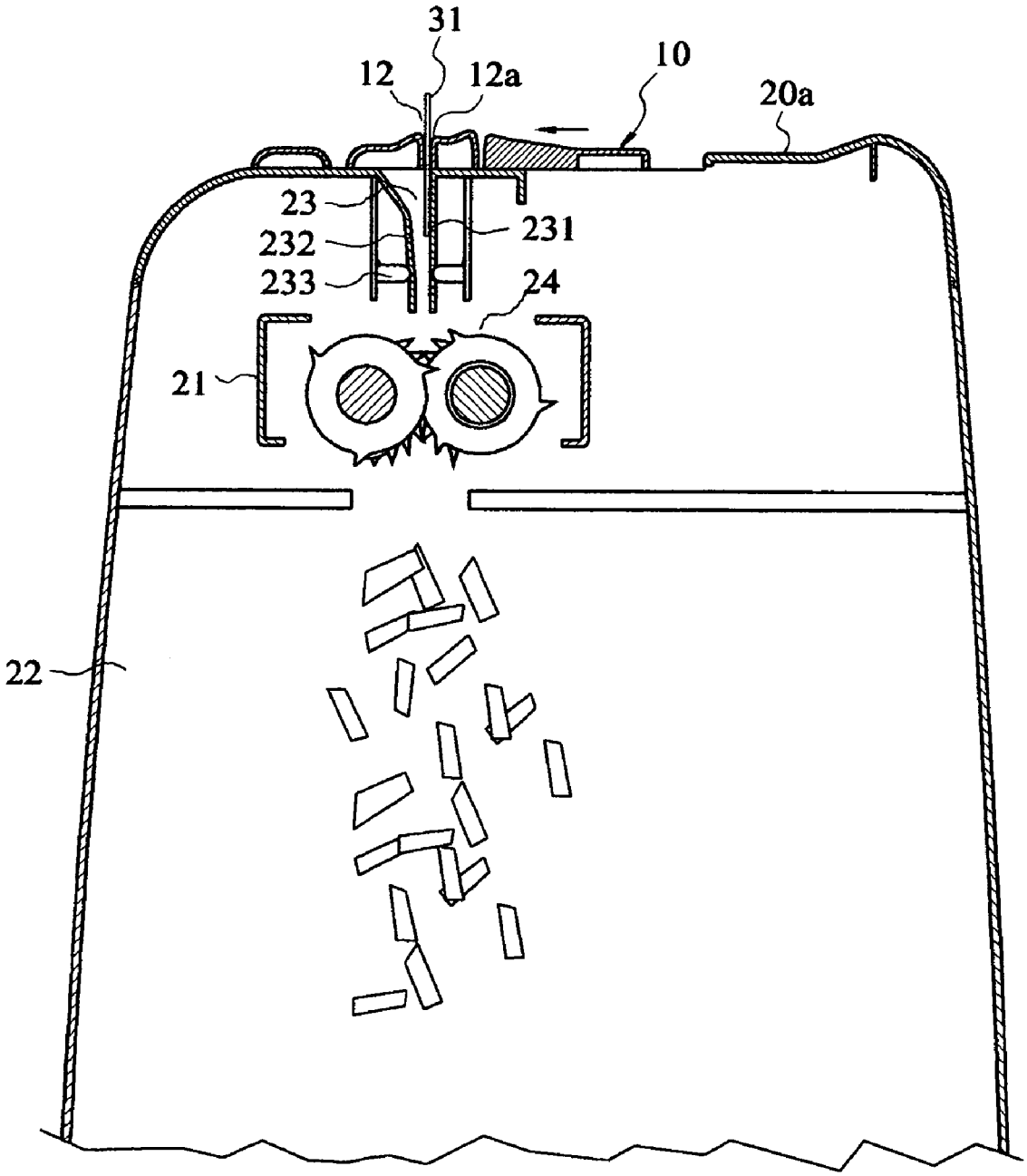
FIG. 6 is a schematic view of a second use of the sliding panel structure according to the present invention.

Referring to FIG. 6, the second inlet 12 of the sliding panel 10 in accordance with the present invention has a length suitable for feeding a credit card 31 and the second inlet 12 forms a guide section 12*a* having a smaller width, a larger height, and a smaller angle, such that when the positioning pin 14 falls into the second aligner 262, the second inlet 12 is aligned with the top of the perpendicular wall surface 231 of the feeding slot 23. If a credit card 31 is placed into the second inlet 12, the credit card 31 will enter perpendicularly into the middle of the rolling blade wheels 24 due to the harder and thicker plastic material of the credit card 31, and the credit card 31 can be supported by the sidewall 231 for shredding and scraping the credit card 31 when it is cut by the knife.

Figure 7:
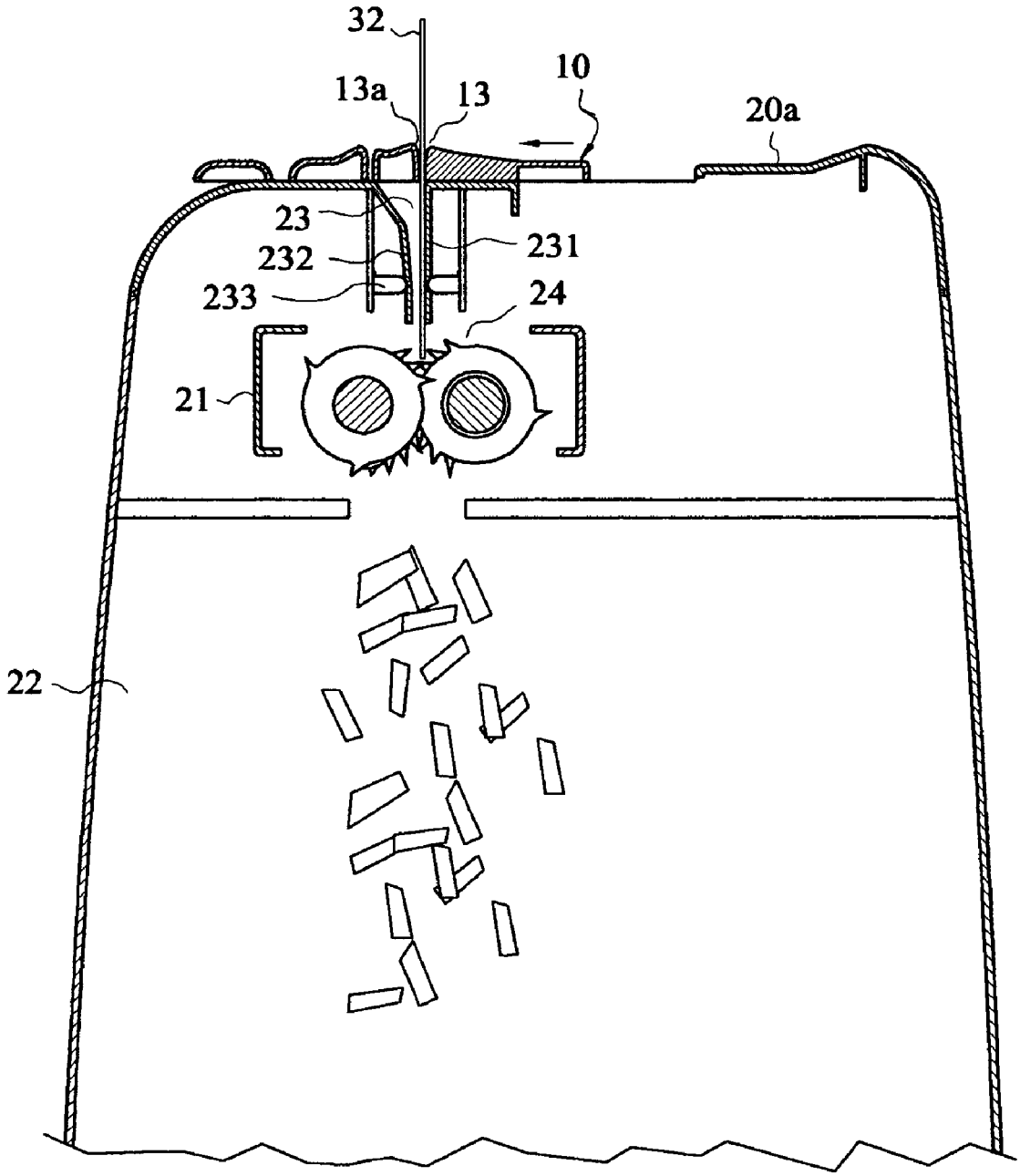
FIG. 7 is a schematic view of a third use of the sliding panel structure according to the present invention.

Referring to FIG. 7, the third inlet 13 of the sliding panel 10 in accordance with the present invention has a length suitable for feeding a compact disc 32 and the second inlet 12 forms a guide section 13*a* having a smaller width, a larger height, and a smaller angle, such that when the positioning pin 14 falls into the third aligner 263, the third inlet 13 is aligned with the top of the perpendicular wall surface 231 of the feeding slot 23. If a compact disc 32 is placed into the third inlet 13, the compact disc 32 will enter perpendicularly into the middle of the rolling blade wheels 24 due to the harder and thicker plastic material of the compact disc 32, and the compact disc 32 can be supported by the sidewall 231 for shredding and scraping the compact disc 32 when it is cut by the knife.

In summation of the description above, the sliding panel structure of a multifunctional paper shredder in accordance with the present invention has designed a plurality of inlets for selectively receiving and shredding paper of different materials, credit cards, and compact discs, and such design is definitely a novel, improved and useful invention.

While the invention has been described by way of examples and in terms of preferred embodiments, it is to be understood that the invention is not limited thereto. The foregoing turning devices including the sliding panel structure and the rolling blade wheel mechanism can be installed on a lateral side of the housing to achieve the same effects without any technical difficulty. Thus, it is intended to cover various modifications and similar arrangements and procedures, and the scope of the appended claims therefore should be accorded the broadest interpretation so as to encompass all such modifications and similar arrangements and procedures.

What is claimed is:

1. A multifunctional paper shredder comprising:

a housing, enclosing an interior space and having a top panel at its top, and having an installing section disposed at an upper section of said interior space and an accommodating space disposed at a lower section of said interior space, and a feeding slot being defined on said top panel;

a pair of rolling blade wheels, being installed at said installing section and situated under said feeding slot and driven by a dynamic force;

at least one wall surface is extended vertically down from an inner side of said feeding slot of said top panel and aligned at the middle position of said pair of rolling blade wheels;

an accommodating section is disposed on an external surface of said top panel, and at least one positioning section is disposed at said upper section under said accommodating section and perpendicular to said feeding slot and at least one sliding groove is parallel to said positioning section;

a sliding panel comprising at least two inlets and slidably installed into said accommodating section, at least one positioning pin passing through said positioning section correspondingly, and at least one sliding pin being embedded into said sliding groove for guiding the movement of said sliding panel.

2. The multifunctional paper shredder of claim 1, wherein said accommodating section comprises a pair of sliding grooves separately disposed on both sides of said positioning section, and said sliding panel comprises a pair of sliding pins correspondingly embedded into said sliding grooves, and a hook section is defined at an outer side of an end of said sliding pin.

3. The multifunctional paper shredder of claim 2, wherein said sliding panel comprises a first inlet, a second inlet; and a third inlet and said inlets are of unequal lengths, and said positioning section comprises a first aligner, a second aligner and a third aligner, and said first, second and third aligners are interconnected by a sliding groove.

4. The multifunctional paper shredder of claim 3, wherein said positioning pin has a C-shape cross section and a flexible property for sliding in said sliding groove.

5. The multifunctional paper shredder of claim 4, wherein said third inlet is aligned with said feeding slot when said positioning pin is situated at said third aligner.

6. The multifunctional paper shredder of claim 5, wherein said third inlet of said sliding panel has a length suitable for feeding a compact disc, and forms a guide section having a smaller width, a larger height and a smaller angle and is aligned with a wall surface perpendicular to said feeding slot.

7. The multifunctional paper shredder of claim 4, wherein said first inlet is aligned with said feeding slot when said positioning pin is situated at said first aligner.

8. The multifunctional paper shredder of claim 7, wherein said first inlet of said sliding panel has a length suitable for feeding a piece of paper, and forms a guide section having a larger width, a smaller height and a smoother angle.

9. The multifunctional paper shredder of claim 4, wherein said second inlet is aligned with said feeding slot when said positioning pin is situated at said second aligner.

10. The multifunctional paper shredder of claim 9, wherein said second inlet of said sliding panel has a length suitable for feeding a credit card, and forms a guide section having a smaller width, a larger height and a smaller angle and is aligned with a wall surface perpendicular to said feeding slot.

11. The multifunctional paper shredder of claim 1, wherein said accommodating section is in a semicircular shape, and said sliding panel forms a semicircle corresponding to said accommodating section.

12. The multifunctional paper shredder of claim 1, wherein said feeding slot comprises an infrared sensor disposed on an outer side of two walls of said feeding slot.

13. The multifunctional paper shredder of claim 1, wherein said sliding panel structure is installed on a lateral surface of said housing.

* * * * *